US007097334B2

(12) United States Patent
Ishida et al.

(10) Patent No.: US 7,097,334 B2
(45) Date of Patent: Aug. 29, 2006

(54) LIGHT SOURCE UNIT FOR VEHICULAR LAMP

(75) Inventors: Hiroyuki Ishida, Shizuoka (JP); Masashi Tatsukawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 9 days.

(21) Appl. No.: 10/419,874

(22) Filed: Apr. 22, 2003

(65) Prior Publication Data

US 2003/0214815 A1 Nov. 20, 2003

(30) Foreign Application Priority Data

Apr. 23, 2002 (JP) ..... P.2002-120346

(51) Int. Cl.
*F21V 7/04* (2006.01)

(52) U.S. Cl. ..... 362/516; 362/245; 362/545; 362/555; 362/612; 362/327; 362/548

(58) Field of Classification Search ..... 362/245, 362/308, 328, 296, 555, 612, 327, 545, 548
See application file for complete search history.

(56) References Cited

U.S. PATENT DOCUMENTS

| | | | | |
|---|---|---|---|---|
| 2,740,318 | A * | 4/1956 | Sharp | 362/253 |
| 4,914,747 | A | 4/1990 | Nino | |
| 5,349,504 | A * | 9/1994 | Simms et al. | 362/555 |
| 5,865,529 | A * | 2/1999 | Yan | 362/327 |
| 6,086,231 | A | 7/2000 | Kenjo et al. | |
| 6,179,456 | B1 | 1/2001 | Nakamura et al. | |
| 6,210,028 | B1 | 4/2001 | Murakoshi et al. | |
| 6,280,071 | B1 | 8/2001 | Yamamoto et al. | |
| 6,406,173 | B1 | 6/2002 | Serizawa et al. | |
| 6,411,022 | B1 | 6/2002 | Machida | |
| 6,737,811 | B1 * | 5/2004 | Zhang et al. | 315/56 |
| 6,948,835 | B1 * | 9/2005 | King et al. | 362/512 |
| 2002/0101734 | A1 * | 8/2002 | Tokida et al. | 362/245 |
| 2004/0042212 | A1 * | 3/2004 | Du et al. | 362/296 |

FOREIGN PATENT DOCUMENTS

DE 100 32 839 A1 2/2002

(Continued)

*Primary Examiner*—Sandra O'Shea
*Assistant Examiner*—Anabel Ton
(74) *Attorney, Agent, or Firm*—Sughrue Mion, PLLC

(57) ABSTRACT

A light source unit capable of considerably reducing the size of a vehicular lamp. An LED is mounted on an optical axis extending in the longitudinal direction of the vehicle with its light output directed upward, and a reflector is provided above the LED having a first reflecting surface for collecting the light emitted by the LED and reflecting the light generally in the direction of the optical axis Ax. The reflector is formed by a reflective coating formed on the surface of a translucent block covering the LED. Consequently, the size of the reflector can be considerably reduced as compared with reflectors employed in conventional vehicular lamps. Moreover, since the LED used as a light source emits little heat, the reflector can be designed without having to take into account the influence of heat generated by the light source. Furthermore, the LED can be treated substantially as a point light source so that proper reflection control can be carried out even if the size of the reflector is reduced. By mounting the LED so that its light output is directed substantially orthogonal to the optical axis Ax, moreover, it is possible to effectively utilize most of the light emitted by the LED and reflected by the first reflecting surface.

14 Claims, 14 Drawing Sheets

FOREIGN PATENT DOCUMENTS

| | | | |
|---|---|---|---|
| EP | 0 713 052 | A1 | 5/1996 |
| GB | 521268 | | 5/1940 |
| JP | 9-330604 | A | 12/1997 |
| JP | 10-200168 | A | 7/1998 |
| JP | 2000-77689 | A | 3/2000 |
| JP | 2001-332104 | A | 11/2001 |
| JP | 2002-42520 | A | 2/2002 |
| JP | 2002-50214 | A | 2/2002 |

* cited by examiner

LIGHT SOURCE UNIT FOR VEHICULAR LAMP

CROSS-REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND OF THE INVENTION

The present invention relates to a light source unit for use in a vehicular lamp.

Conventionally, a so-called projection-type vehicular lamp implemented as a headlamp has been known.

In a projection-type vehicular lamp, light emitted by a light source disposed on the optical axis of the lamp is collected and reflected forward in the direction of the optical axis by a reflector, and the reflected light is radiated in the forward direction of the lighting unit through a projection lens mounted in front of the reflector.

By employing such a projection-type vehicular lamp it is possible to reduce the overall size of the lighting unit compared with a so-called parabolic-type vehicular lamp.

However, in the conventional projection-type vehicular lamp where a discharge light-emitting section of a discharge bulb or a filament of a halogen bulb is used for a light source thereof, the following problem occurs.

More specifically, because the actual light-emitting portion of the light source has a certain finite size, in order to appropriately reflect and control the light emitted by the light source it is necessary to provide a relatively large reflector. Moreover, it is necessary to provide a space for mounting and supporting the discharge or halogen bulb on the reflector, which further contributes to the need for a relatively large reflector. Also, the light source generates considerable heat, and the influence of the heat must be taken into consideration in the design of the reflector.

From the foregoing, there is a problem that a significant reduction in the size of the lighting unit cannot be obtained with the conventional projection-type vehicular lamp.

JP-A-2002-50214, JP-A-2001-332104 and JP-A-9-330604 disclose a vehicular lamp using an LED, which is a small-sized light source. Moreover, JP-A-2002-42520 and JP-A-2000-77689 teach a light-emitting device having a reflecting surface provided close to an LED. These references do not, however, teach a light source suitable for use in a vehicular headlamp or the like.

BRIEF SUMMARY OF THE INVENTION

In consideration of the problems mentioned above, it is an object of the invention to provide a light source unit which allows the size of a vehicular lamp to be significantly reduced.

To achieve the above and other objects, the invention employs a semiconductor light-emitting element as a light source together with an appropriately designed reflector.

More specifically, the invention provides a light source unit for use in a vehicular lamp, comprising a semiconductor light-emitting element arranged on the optical axis of the light source unit with its light output directed in a predetermined direction substantially orthogonal to the optical axis, and a reflector provided on a forward side in the predetermined direction with respect to the semiconductor light-emitting element and having a first reflecting surface to collect light emitted by the semiconductor light-emitting element and reflect the light forward in the direction of the optical axis, wherein the reflector is formed by a reflective coating formed on a surface of a translucent block which covers the semiconductor light-emitting element, and a part of the surface of the translucent block constitutes the first reflecting surface. The term "light output directed in a predetermined direction" means that the central axis of the generally hemispherical light flux produced by the semiconductor light-emitting element is directed in the predetermined direction.

The vehicular lamp in which the light source unit of the invention can be employed is not restricted to a specific type of lamp, and it may be embodied as a headlamp, a fog lamp or a cornering lamp, for example.

The optical axis of the light source unit may extend in the longitudinal direction of the vehicle or in another direction.

The above-mentioned predetermined direction is not restricted to a specific direction as long as it is substantially orthogonal to the optical axis of the light source unit, and it can be in the upward, transverse or downward direction with respect to the optical axis.

While the specific type of the semiconductor light-emitting element is not particularly limited, an LED (light-emitting diode) or an LD (laser diode) can be employed, for example.

The material of which the translucent block is constructed is not particularly restricted. For example, it is possible to employ a block formed of a transparent synthetic resin or a block formed of glass. Moreover, the surface of the translucent block which performs the reflecting function does not always need to be an outer surface, and a protective coating film formed on the outer peripheral surface or a coating member can be employed. In the latter case, the specific structure of the coating member is not particularly restricted, and a member formed of the same material as that of the translucent block may be used, for example.

As described herein, the invention provides a light source unit comprising a semiconductor light-emitting element arranged on the optical axis of the light source unit with its light output directed in a predetermined direction substantially orthogonal to the optical axis, and a reflector extending on a forward side in the predetermined direction with respect to the semiconductor light-emitting element and having a first reflecting surface to collect light emitted by the semiconductor light-emitting element and reflect the light forward in the direction of the optical axis, wherein the reflector is formed by a reflective coating formed on a surface of a translucent block which covers the semiconductor light-emitting element, so that part of the surface of the translucent block constitutes the first reflecting surface. That is, the internal reflecting property of the first reflecting surface is utilized for the reflector. With this construction, the size of the reflector can be reduced considerably compared with a reflector used in a conventional projection-type vehicular lamp. Consequently, the size of the reflector can be made considerably smaller than that of a reflector used in a conventional projection-type vehicular lighting unit.

Because a semiconductor light-emitting element is used as the light source, the light source can be treated substantially as a point light source. Thus, even if the size of the reflector is reduced, the light emitted by the semiconductor light-emitting element can be appropriately reflected and controlled by the reflector. In addition, the semiconductor light-emitting element is arranged with its light output directed in a predetermined direction substantially orthogonal to the optical axis of the light source unit. Consequently, most of the light emitted by the semiconductor light-emitting element is reflected by the first reflecting surface and utilized in the output light beam from the light source.

Moreover, since a semiconductor light-emitting element is used as the light source, it is not necessary to provide a large space such as needed for mounting a discharge or halogen bulb on the reflector, thereby further contributing to a reduction in the size of the reflector. In addition, semiconductor light-emitting elements emit little heat, again promoting a reduction in the size of the reflector.

Accordingly, by using a light source unit constructed according to the invention in a vehicular lamp, it is possible to considerably reduce the overall size of the vehicular lamp.

In the invention, particularly due to the fact that the reflector is constituted by a translucent block formed to cover the semiconductor light emitting element, it is possible to construct the light source unit with only a small number of components.

Generally, if the size of a reflector is reduced, it is required to maintain high precision for the positional relationship between the light source and the reflecting surface of the reflector. In the invention, however, where the reflector is constituted by the translucent block formed to cover the semiconductor light emitting element, it is easily possible to maintain the necessary degree of precision in the positional relationship between the semiconductor light emitting element and the first reflecting surface.

As a further advantage of constructing the reflector with a translucent block formed to cover the semiconductor light emitting element, the strength of the light source unit is increased, and it is possible to effectively prevent shifting of the position of the light source due to vibration or impact which could result in a disturbance of the light distribution of the lighting unit.

One or a plural number of light source units constructed according to the invention may be used in a vehicular lamp. In the latter case, the brightness of the vehicular lamp can be increased corresponding to the number of light source units. The arrangement of the plural light source units can easily be set in accordance with the given design parameters. That is, the use of light source units of the invention results in a wide latitude in designing a vehicular lamp.

Further, if the first reflecting surface is formed in such a manner that the distance in the predetermined direction from the semiconductor light emitting element to the first reflecting surface is 20 mm or less, the size of the reflector can be reduced to a significant extent.

A second reflecting surface may be provided at the front end in the direction of the optical axis on the surface of the translucent block, and the second reflecting surface may be inclined forwardly in the direction of the optical axis, in which case the solid angle subtended by the reflector can be increased correspondingly. Consequently, the proportion of the luminous flux from the light source unit utilized in the output beam can be further increased.

If the end face for emitting light reflected by the first reflecting surface from the translucent block forward in the direction of the optical axis is made substantially fan-shaped about the optical axis, it is possible to form a light distribution pattern having a cut-off line, such as required for a low-beam distribution pattern of a headlamp, with the beam radiated from the light source unit.

In such a case, if a planar section is formed on the surface of the translucent block extending rearward from the emitting end face in the direction of the optical axis and is formed as a third reflecting surface for reflecting light reflected by the first reflecting surface generally in the predetermined direction, light which would not otherwise reach the emitting end face can be effectively used and made to reach the emitting end face. Consequently, the same light can be effectively used practically for a beam irradiation. Thus, the amount of luminous flux produced by the light source unit can be still further increased.

In the case in which the light source unit according to the invention is used in a vehicular lamp, a projection lens is generally required. The light source unit according to the invention may incorporate the projection lens, although this need not always be the case. If a projection lens is to be included with the light source unit, the projection lens may be provided at a predetermined position on the forward side in the direction of the optical axis with respect to the reflector. In the latter case where the projection lens is not directly integrated with the light source unit, it is preferable that the projection lens is still provided at the predetermined position on the forward side in the direction of the optical axis with respect to the light source unit. However, in the case where the projection lens is integrated with the structure of the light source unit the positional relationship among the projection lens and the reflector (as well as the light control member, if present) can be established with a high degree of precision prior to final assembly of the vehicular lamp. Consequently, it is possible to more easily assemble the vehicular lamp.

DETAILED DESCRIPTION OF THE INVENTION

Preferred embodiments of the invention will be described below with reference to the drawings.

Figure 1:
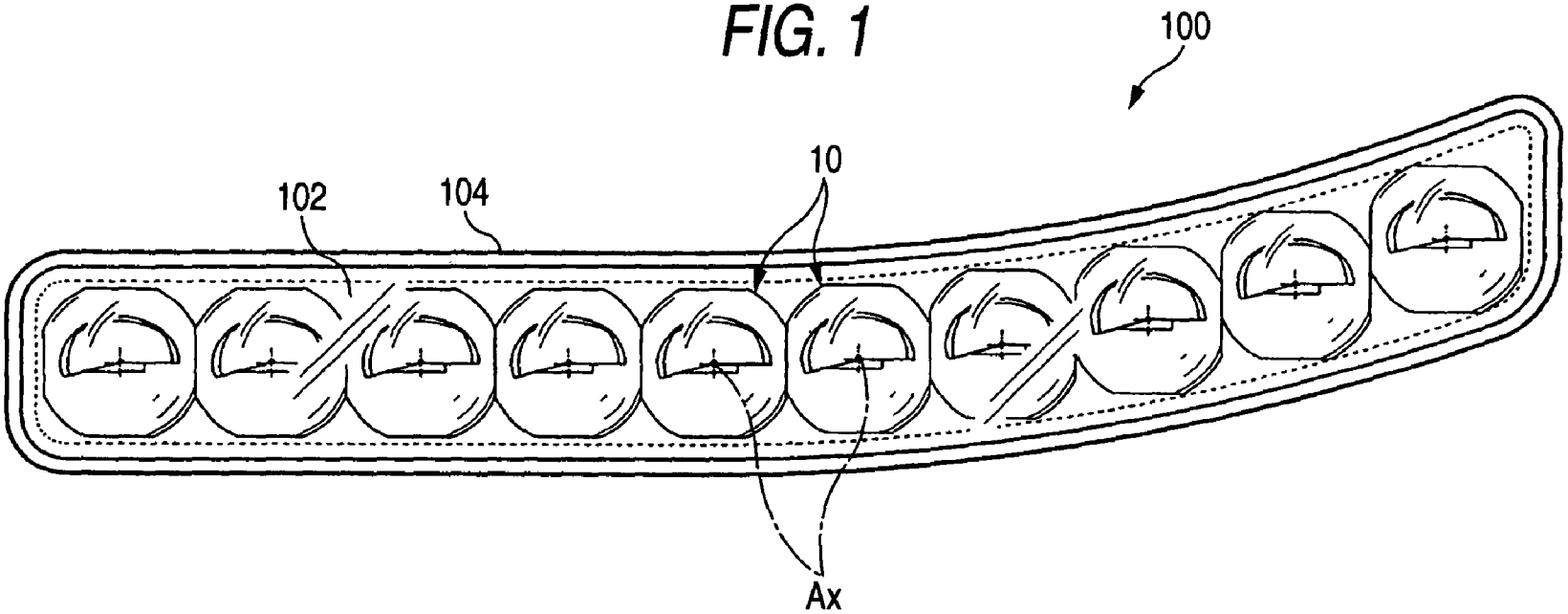
FIG. 1 is a front view showing a first example of a vehicular lamp which includes plural light source units constructed according to a first embodiment of the invention.

FIG. 1 is a front view showing a vehicular lamp 100 which incorporates a light source unit 10 constructed according to a first embodiment of the invention.

The lighting unit 100 is a low-beam headlamp incorporating ten light source units 10 arranged in a substantially horizontal line in a lamp housing formed by a transparent cover 102 and a lamp body 104.

The light source units 10, which all have the same structure, are accommodated in the lamp housing with their optical axes Ax extending generally in the longitudinal direction of the vehicle, more specifically, in a downward direction by approximately 0.5 to 0.6 degree with respect to the longitudinal direction of the vehicle.

Figure 2:
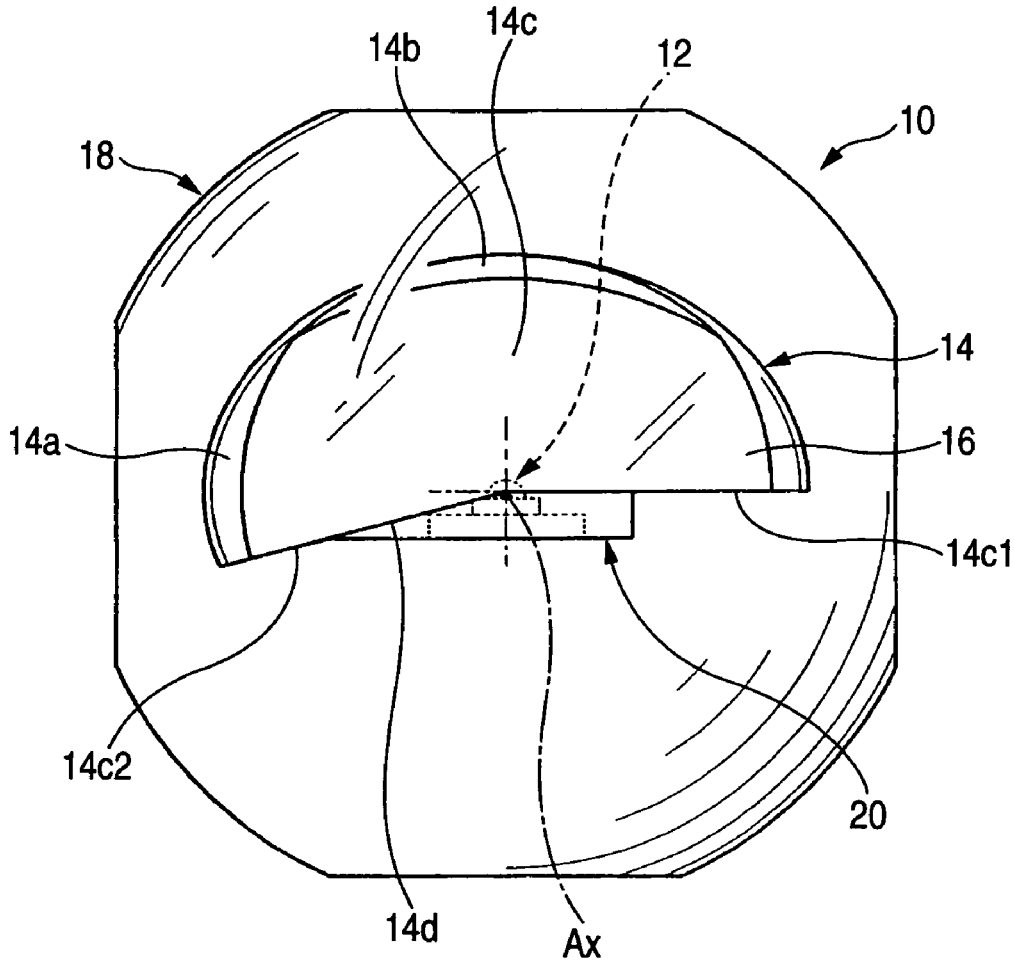
FIG. 2 is a front view showing a light source unit included in the vehicular lamp of FIG. 1.
Figure 3:
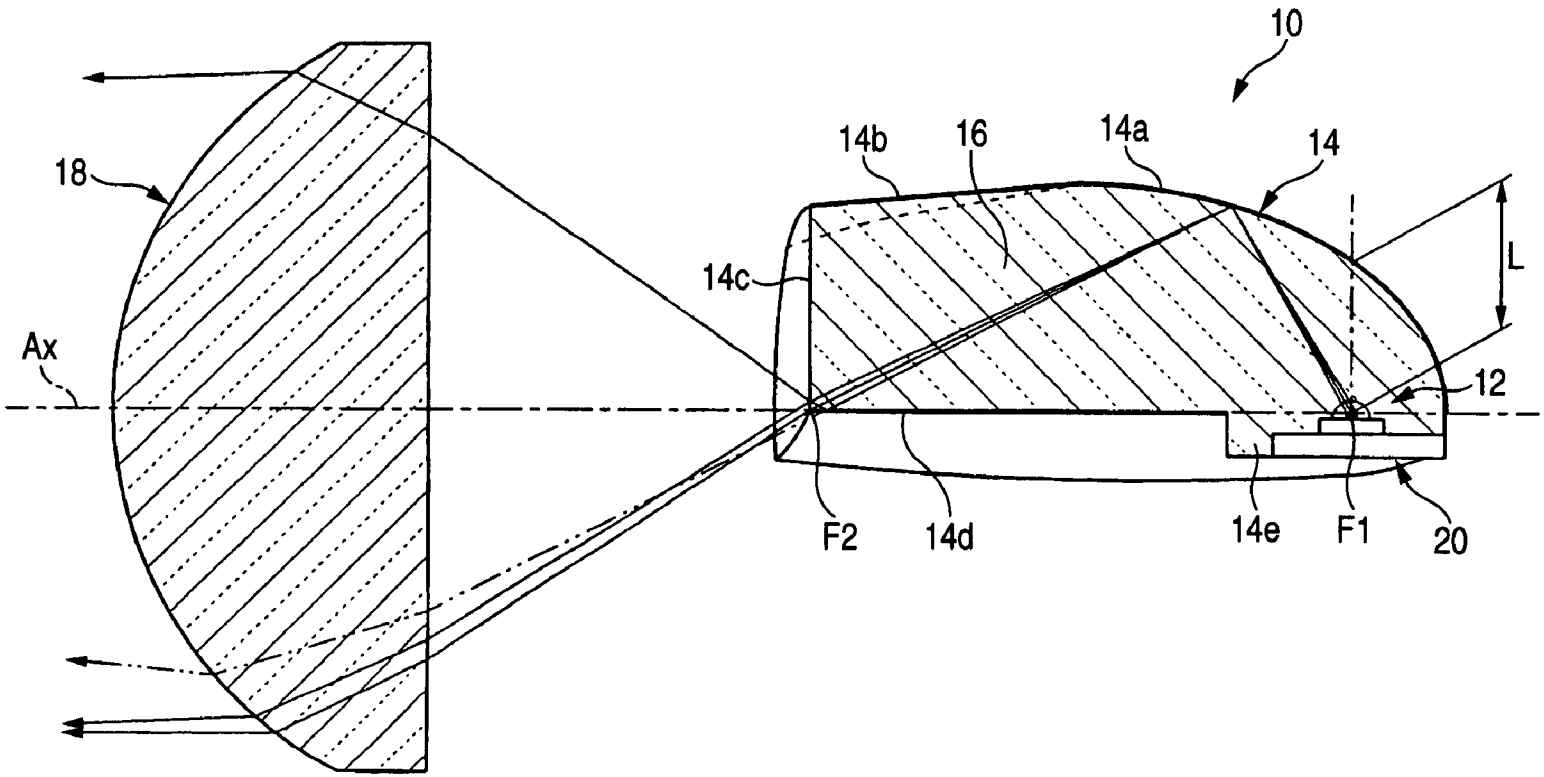
FIG. 3 is a sectional side view showing the light source unit of FIG. 1.
Figure 4:
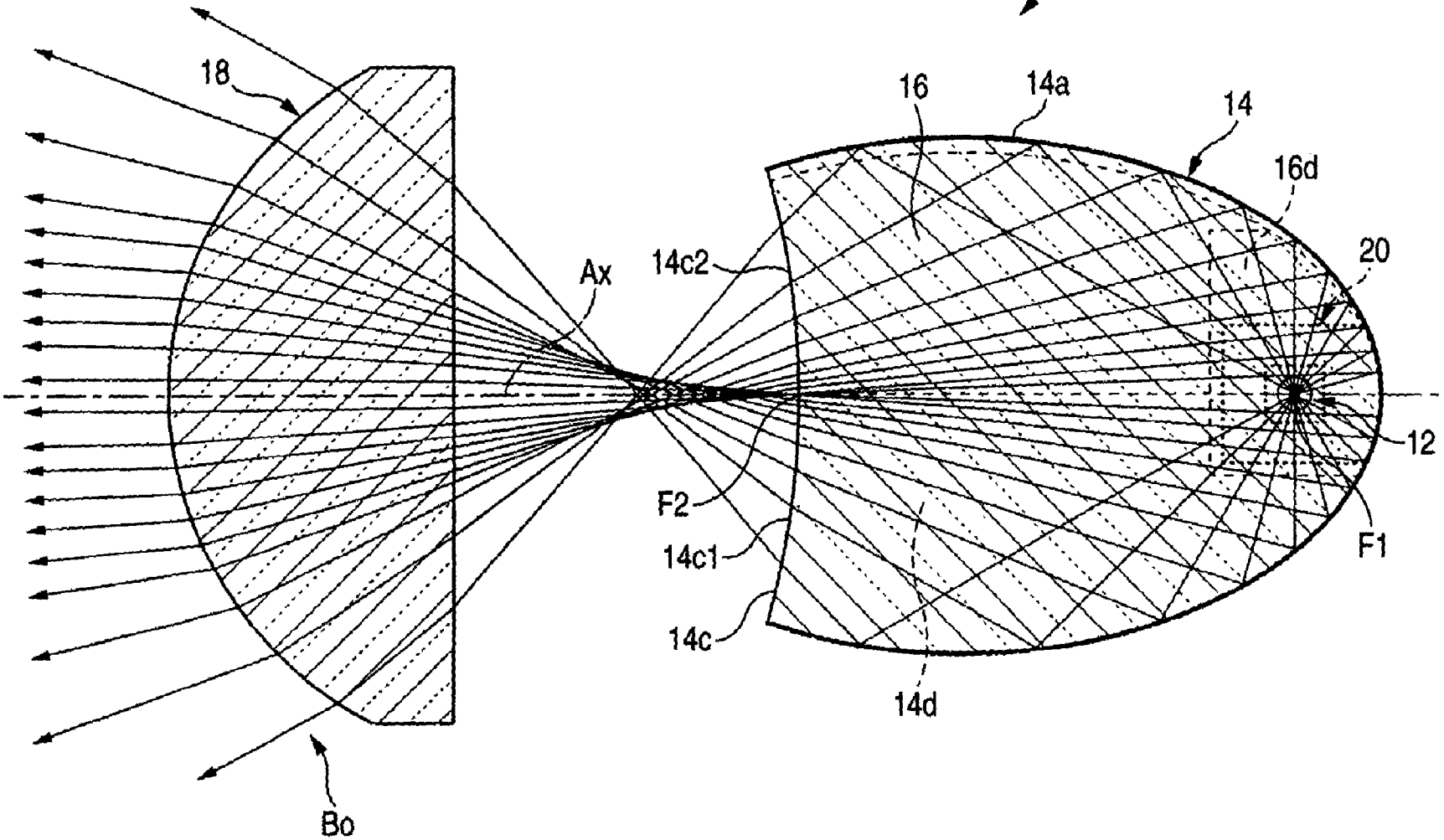
FIG. 4 is a sectional plan view showing the light source unit of FIG. 1.

FIG. 2 is a front view showing a single light source unit 10, and FIGS. 3 and 4 are sectional side and plan views, respectively, of the light source unit 10.

As shown in these drawings, the light source unit 10 includes an LED 12 (a semiconductor light-emitting element) as a light source, a reflector 14, a light control member 16 and a projection lens 18.

The LED 12, which is a white LED including a light-emitting section having a size of approximately 1 mm square, is supported on a substrate 20 at a position on the optical axis Ax with its light output directed upward.

The reflector 14 is formed by making the surface of a translucent block 16 formed to cover the LED 12 on its upper side a reflecting surface. A part of the surface of the translucent block 16 is constituted as a first reflecting surface 14*a* for collecting light emitted by the LED 12 and reflecting it in the direction of the optical axis Ax. The first reflecting surface 14*a* is formed in such a manner that a distance L in a vertical direction from the LED 12 to the first reflecting surface 14*a* is 20 mm or less, preferably approximately 10 mm.

The first reflecting surface 14*a* is substantially elliptically shaped in cross section with the optical axis Ax as its central axis. More specifically, the first reflecting surface 14*a* has a sectional shape in a planar section including the optical axis Ax which is substantially elliptical, but with an eccentricity which gradually increases from a vertical section toward a horizontal section and with the vertex at the rear side of the ellipse for all sections being the same. The LED 12 is positioned at a first focal point F1 of the ellipse in the vertical section of the first reflecting surface 14*a*. With this configuration, the first reflecting surface 14*a* collects and reflects in the direction of the optical axis Ax the light emitted by the LED 12, and substantially converges the light at a second focal point F2 of the ellipse in the vertical section on the optical axis Ax.

The front end of the first reflecting surface 14*a* of the reflector 14 is provided with a second reflecting surface 14*b* which is inclined downward with respect to the optical axis Ax in a forward direction from the first reflecting surface 14*a*.

The front end of the translucent block 16 has an emitting end face 14*c* through which is emitted light reflected by the first reflecting surface 14*a*. The emitting end face 14*c* is generally fan-shaped with a central angle of 195 degrees about the optical axis Ax. The lower edge of the emitting end face 14*c* is constituted by a horizontal cut-off line forming section 14*c*1 extending horizontally in a leftward direction from the optical axis Ax and an oblique cut-off line forming section 14*c*2 extending obliquely and downward by an angle of about 15 degrees in a rightward direction from the optical axis Ax. The intersecting point of the horizontal cut-off line forming section 14*c*1 and the oblique cut-off line forming section 14*c*2 is aligned with the second focal point F2.

The lower end of the translucent block 16 is provided with a planar section extending rearward from the emitting end face 14*c* with the shape of the lower edge of the emitting end face 14*c* maintained along its length. The surface of the planar section is also made reflecting to thereby form a third reflecting surface 14*d* for reflecting the light reflected by the first reflecting surface 14*a* generally in the upward direction. A light control section for controlling a part of the light reflected by the first reflecting surface 14*a* is constituted by the third reflecting surface 14*d*.

A substrate support section 14*e* is formed on the lower surface of the rear end of the translucent block 16, and the substrate 20 is fixed to the translucent block 16 via the substrate support section 14*e*.

The projection lens 18, which is disposed on the optical axis Ax, causes the focal position on the rear side to be coincident with the second focal point F2 of the first reflecting surface 14*a* of the reflector 14. Consequently, an image formed on a focal plane including the second focal point F2 is projected forward as an inverted image. The projection lens 18 is a planoconvex lens with the surface on the forward side being a convex surface and the surface on the rearward side being a planar surface. Four vertical and transverse portions of the lens which are not used in focusing light are chamfered to reduce the size and weight of the lens. The projection lens 18 is fixed to the translucent block 16 through a bracket (not shown).

The emitting end face 14*c* of the translucent block 16 is formed in such a manner that both left and right sides are curved forward in an imaginary surface corresponding to the image surface of the projection lens 18.

Figure 5:
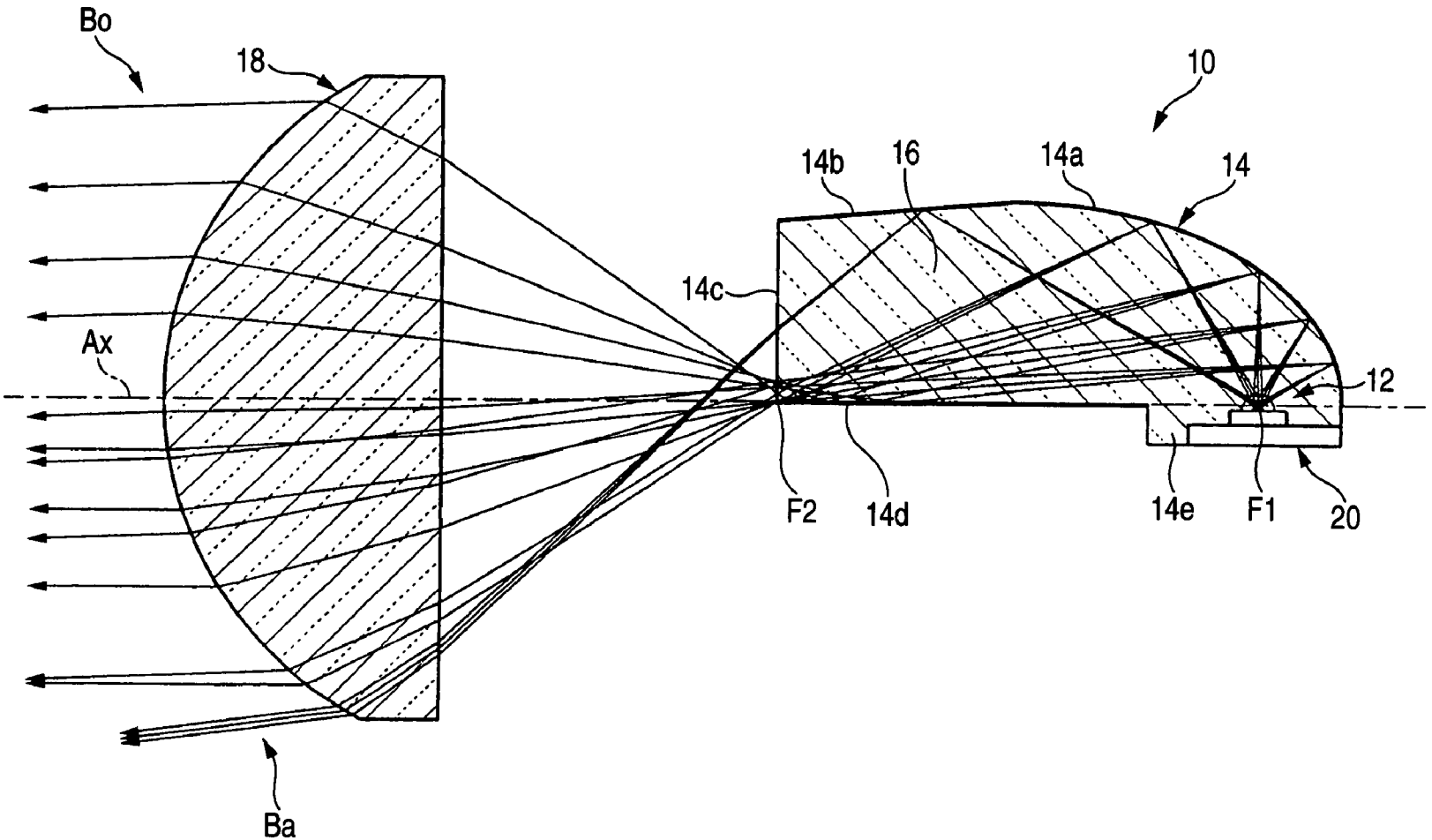
FIG. 5 is a sectional side view showing in detail the optical path of a beam radiated from the light source unit of FIG. 1.

FIG. 5 is a sectional side view showing in detail the optical paths of various beams which compose the light flux radiated from the light source unit 10.

As shown in FIG. 5, the light emitted by the LED 12 and reflected by the first reflecting surface 14*a* of the reflector 14 is transmitted toward the lower edge of the emitting end face 14*c*. One part of this light reaches the emitting end face 14*c* directly, while the residual part thereof is reflected by the third reflecting surface 14*d* and then reaches the emitting end face 14*c*. The light reaching the emitting end face 14*c* is refracted by the emitting end face 14*c* and deflected and emitted in a forward direction to be incident on the projection lens 18. The light incident on the projection lens 18 and transmitted therethrough is emitted as a low beam Bo forward from the projection lens 18.

On the other hand, the light from the LED 12 which is reflected by the second reflecting surface 14*b* of the reflector 14 reaches the emitting end face 14*c* above the second focal point F2, is deflected and emitted forward from the emitting end face 14*c* to be incident on the projection lens 18, and is then emitted as additional light Ba forward from the projection lens 18. The additional light Ba is radiated at a downward angle with respect to the low-beam light Bo.

Figure 6:
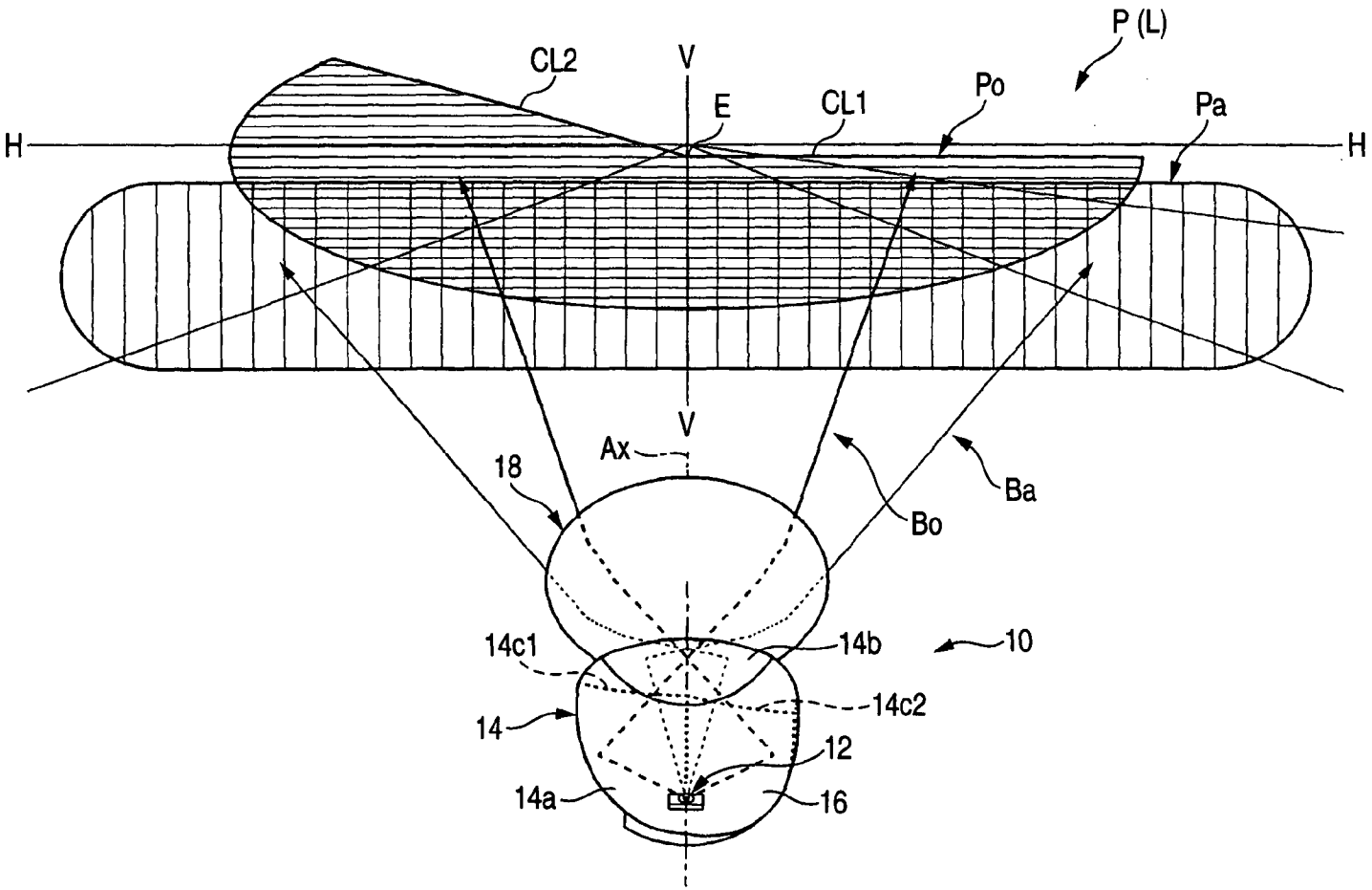
FIG. 6 is a perspective view showing a light distribution pattern formed on a virtual vertical screen at a position 25 m forward of a light source unit of the invention by a beam from the light source unit together with the light source unit as seen from the rear side thereof.

FIG. 6 is a perspective view showing a low-beam distribution pattern P(L) formed on a virtual vertical screen disposed at a position 25 m forward of the lighting unit by a beam radiated forward from the light source unit 10. FIG. 6 also shows the light source unit 10 as seen from the rear side thereof.

As shown in FIG. 6, the low-beam distribution pattern P(L) is formed as a synthesized light distribution pattern including a basic light distribution pattern Po and an additional light distribution pattern Pa.

The basic light distribution pattern Po, which is a leftward light distribution pattern formed by the light reflected from the first reflecting surface 14*a* (the low-beam radiated light Bo), has horizontal and oblique cut-off lines CL1 and CL2 on the upper edge thereof The horizontal cut-off line CL1 is formed as the inverted image of the horizontal cut-off line forming section 14*c*1 of the emitting end face 14*c* on the right side of the H-V intersection (the intersection of horizontal and vertical axes just in front of the lighting unit), and the oblique cut-off line CL2 is formed as the inverted image of the oblique cut-off line forming section 14*c*2 of the light control member 14*c* on the left side of the H-V intersection. The position of the intersection point (elbow point) E of the horizontal cut-off line CL1 and the oblique cut-off line CL2 is slightly below the position of the H-V intersection (downward at an angle of approximately 0.5 to 0.6 degree). Visibility in distant portions of the road surface in front of the vehicle is maintained by the basic light distribution pattern Po.

On the other hand, the additional light distribution pattern Pa, which is a light distribution pattern formed by the light reflected by the second reflecting surface 14*b* (the additional radiated light Ba), overlaps with the lower half part of the basic light distribution pattern Po and is diffused widely in the transverse direction. Visibility in short-distance regions on the road surface in front of the vehicle is maintained by the additional light distribution pattern Pa.

The vehicular lamp 100 according to this example employs ten light source units 10. Therefore, beam radiation is performed with a synthesized light distribution pattern wherein the low-beam distribution patterns P(L) formed by each of the ten light source units 10 are combined. Consequently, the brightness necessary for low-beam illumination by the headlamp is attained.

As described above in detail, the light source unit 10 according to the first embodiment includes the LED 12, whose light output is directed upward and which is positioned on the optical axis Ax extending in the longitudinal direction of the vehicle, and the reflector 14, which includes the first reflecting surface 14*a* for collecting and reflecting the light emitted by the LED 12 generally in the direction of the optical axis Ax and which is provided on the upper side of the LED 12. The reflector 14 is formed by a reflective coating formed on a surface of a translucent block 16 which covers the semiconductor light-emitting element, whereby a part of the surface of the translucent block constitutes the first reflecting surface 14*a*. Therefore, the internal reflection of the first reflecting surface 14*a* can be utilized. With this construction, the reflector 14 can be made considerably smaller than a reflector used in a conventional projection-type vehicular lamp.

Since the LED 12 is used as a light source, the light source can be treated substantially as a point light source. Thus, even though the size of the reflector 14 is reduced, the light emitted by the LED 12 nevertheless can be appropriately reflected and controlled by the reflector 14. In addition, the LED 12 is arranged in such a direction as to be substantially orthogonal to the optical axis Ax of the light source unit 10. Therefore, most of the light emitted by the LED 12 can be utilized as light reflected by the first reflecting surface 14*a*.

Moreover, because the LED 12 is used as the light source, it is not necessary to provide a large mounting space, such as is needed when a discharge or halogen bulb is used as in the conventional art. Also in this respect the size of the reflector 14 can be reduced. In addition, because the LED 12 generates very little heat, the influence of heat does not need to be considered in the design of the reflector, further contributing to a reduction in size of the reflector.

Accordingly, when the light source unit 10 according to the invention is used in a vehicular lamp, the size of the lamp can be considerably reduced.

The vehicular lamp 100 according to the above-described example is a low-beam headlamp which employs ten light source units 10 so that the necessary brightness for low-beam radiation can be attained. It is to be noted that the arrangement of the light source units 10 within the headlamp can easily be set optionally, and consequently the freedom in designing the shape of the vehicular lamp is enhanced.

Still further, since the reflector 14 is constituted by the translucent block 16 formed to cover the LED 12, the light source unit 10 can be constituted by a small number of components.

Moreover, since the reflector 14 is constituted by the translucent block 16 formed to cover the LED 12, the necessary precision in the positional relationship between the LED 12 and the first reflecting plane 14*a* is obtained even though the size of the reflector is significantly reduced.

Furthermore, due to the fact that the reflector 14 is constituted by the translucent block 16 formed to cover the LED 12, the strength of the light source unit 10 is increased, and shifting of the position of the light source due to vibration or impact, which could disturb the light distribution pattern of the lighting unit, is prevented.

In the above-described embodiment, the first reflecting surface 14*a* of the reflector 14 is formed in such a manner that the distance L in the vertical direction from the LED 12 to the first reflecting surface 14*a* is approximately 10 mm. Even if the distance L is slightly more than 10 mm (that is, 20 mm or less, preferably 16 mm or less, and more preferably 12 mm or less), the reflector 14 still can be made considerably smaller than a reflector used in a conventional projection-type vehicular lamp.

In the above-described embodiment, the second reflecting surface 14*b* extends forward from the first reflecting plane 14*a* while being inclined with respect to the optical axis Ax. Therefore, the solid angle subtended by the reflector 14 can further be increased correspondingly. Consequently, the amount of luminous flux from the light source unit 10 which is utilized in the output beam can be further increased.

Moreover, the emitting end face 14*c* of the translucent block 16 has a substantially fan-shaped configuration extending through a central angle of 195 degrees about the optical axis Ax. Therefore, the low beam distribution pattern P(L) having the horizontal and oblique cut-off lines CL1 and CL2 can be formed by a beam radiated from the light source unit 10.

Further, the third reflecting surface 14*d*, which is formed as a planar surface extending rearward from the emitting end face 14*c* of the translucent block 16, reflects the light reflected onto the third reflecting surface 14*d* by the first reflecting plane 14*a* in the forward direction toward the emitting end face 14*c*. Therefore, light which would not otherwise reach the emitting end face 14*c* is caused to reach the emitting end face 14*c* and thus be utilized in the output beam. Consequently, the luminous flux of the output beam the light source unit 10 is further increased.

Furthermore, the light source unit 10 according to the embodiment comprises the projection lens 18. Therefore, the positional relationship between the projection lens 18 and the reflector 14 can be set with high precision in a stage prior to the assembly of the lighting unit 100 for a vehicle. Consequently, the lighting unit 100 for a vehicle can easily be assembled.

Figure 7:
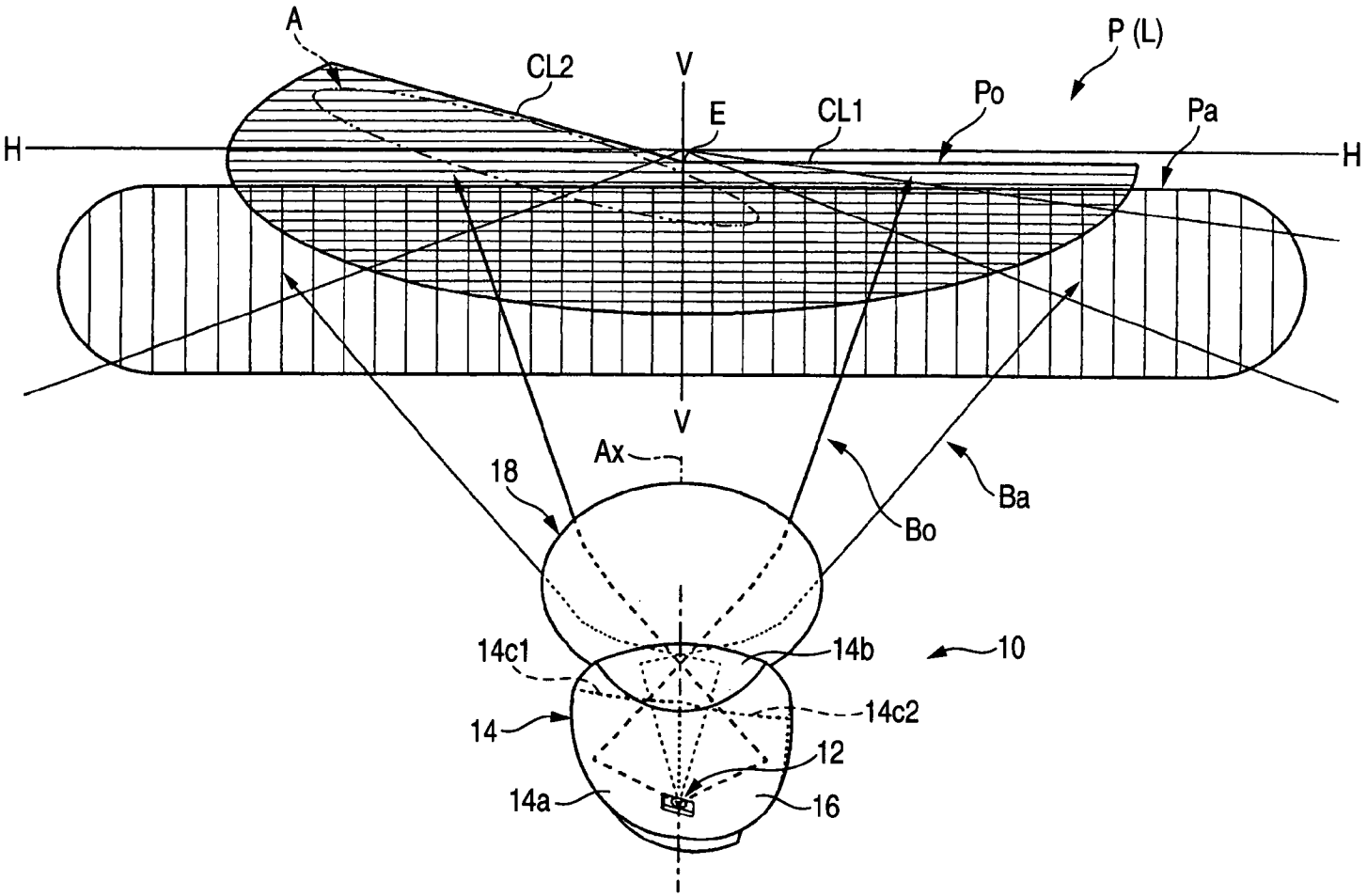
FIG. 7 is a view showing an alternate arrangement of an LED in the embodiment of FIG. 6.

While the LED 12 is arranged with its light output directed in the upward direction in the light source unit 10 according to the above-described embodiment, that is, with its light output substantially orthogonal to the horizontal cut-off line forming surface, it may rotated, for example, by 15 degrees in a rightward direction about the optical axis Ax, as shown in FIG. 7. In such a case, the following functions and effects can be obtained.

Generally, the light distribution curve of the light emitted by the LED has a luminous intensity distribution in which the directly forward direction of the LED has a maximum luminous intensity and the luminous intensity decreases as the angle with respect to the directly forward direction is increased. Therefore, by rotating the LED 12 by 15 degrees as described above, a lower region (indicated by a two-dot chain line in FIG. 7) A of the oblique cut-off line CL2 in the basic light distribution pattern Po can be illuminated more brightly. Consequently, the low-beam distribution pattern P(L) is improved for distant visibility.

As further described above, the lower edge of the emitting end face 14*c* of the translucent block 16 includes the horizontal cut-off line forming surface 14*c*1 and the oblique cut-off line forming surface 14*c*2 in order to obtain the low-beam distribution pattern P(L) having the horizontal and oblique cut-off lines CL1 and CL2. However, the lower edge of the emitting end face 14*c* may have a different shape from that previously described in order to form a low-beam distribution pattern having a different cut-off line pattern (a transversely uneven stepped horizontal cut-off line, for example). It is possible to obtain the same functions and effects as those of the above-described first embodiment in such a case by employing the same structure as that of the first embodiment.

Next, a second embodiment of the embodiment will be described.

Figure 8:
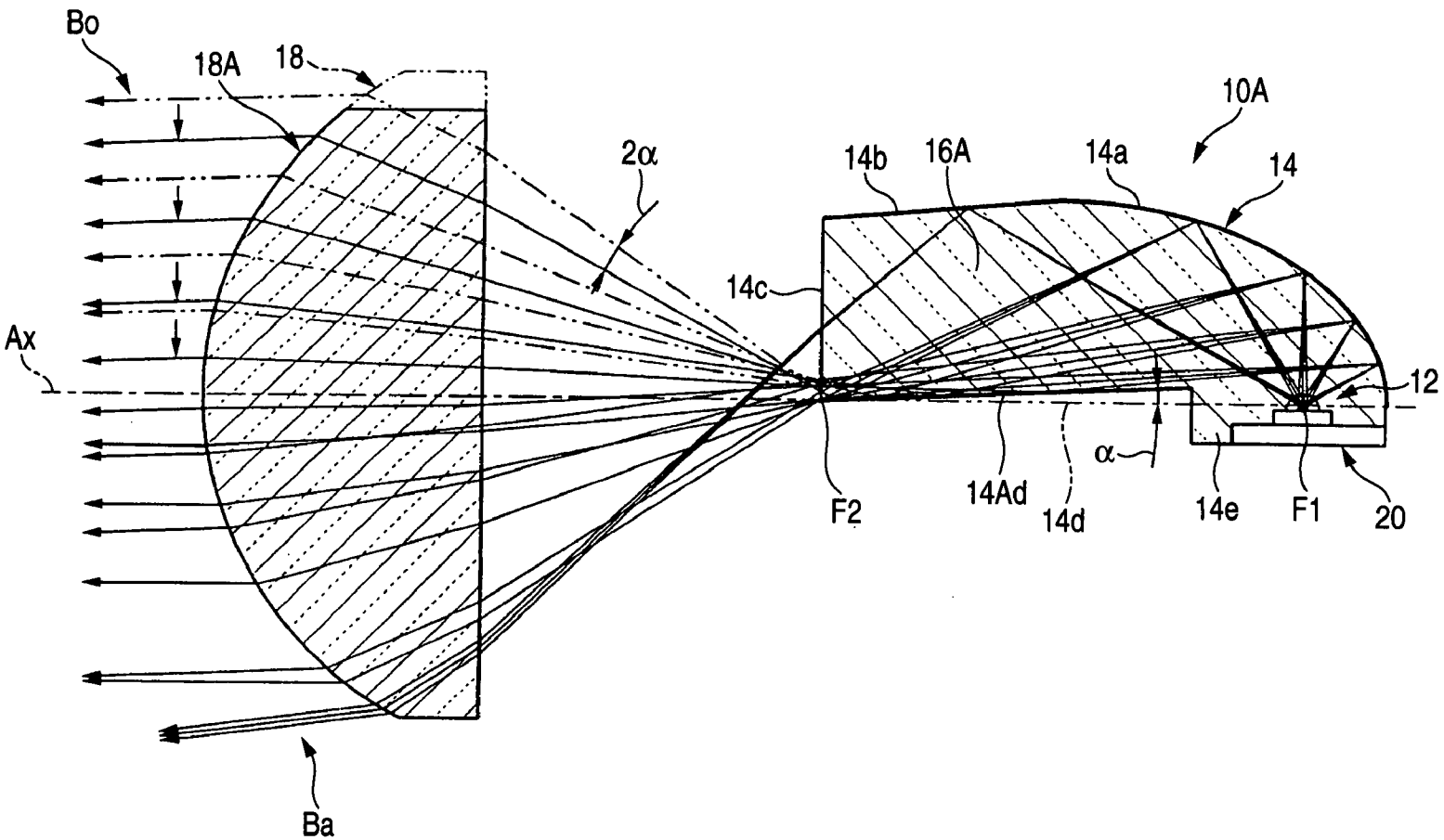
FIG. 8 is a view similar to FIG. 5 showing a second embodiment of a light source unit of the invention.

FIG. 8 is a sectional side view showing a light source unit 10A according to the second embodiment.

As shown in FIG. 8, the light source unit 10A employs different structures for the translucent block 16A and projection lens 18A than those of the translucent block 16 and the projection lens 18 according to the first embodiment, while other structures are the same as those in the first embodiment.

In the translucent block 16A, the shape of an emitting end face 14*c* is the same as that of the translucent block 16 (shown by a two-dot chain line in the drawing) according to the first embodiment, but a third reflecting surface 14Ad is inclined slightly upward and rearward from the emitting end face 14*c*. The angle of inclination a may be approximately 1 to 10 degrees, for example.

With the third reflecting surface 14Ad formed as described above, the angle at which light is reflected upward by the third reflecting surface 14Ad is reduced corresponding to an angle of $2\alpha$ as compared with the first embodiment (the optical path of the reflected light is shown a two-dot chain line in the drawing). Consequently, the angle of upward inclination of the light reflected by the third reflecting surface 14Ad is reduced by an angle of $2\alpha$ as compared with the previously described embodiment (the optical path of the reflected light is indicated by a two-dot chain line in the drawing). Accordingly, the position at which light reflected by the third reflecting surface 14Ad is incident on the projection lens 18A is lower than that in the previously described embodiment.

For this reason, the projection lens 18A according to the second embodiment is cut away at an upper end portion where no light reflected by the third reflecting surface 14Ad is incident (as indicated by a two-dot chain line in FIG. 8).

By employing the structure of the second embodiment, the height of the projection lens 18A can be decreased. Consequently, the size of the light source unit 10A can be reduced still further.

Next, another example of a vehicular lamp employing light source units of the invention will be described.

Figure 9:
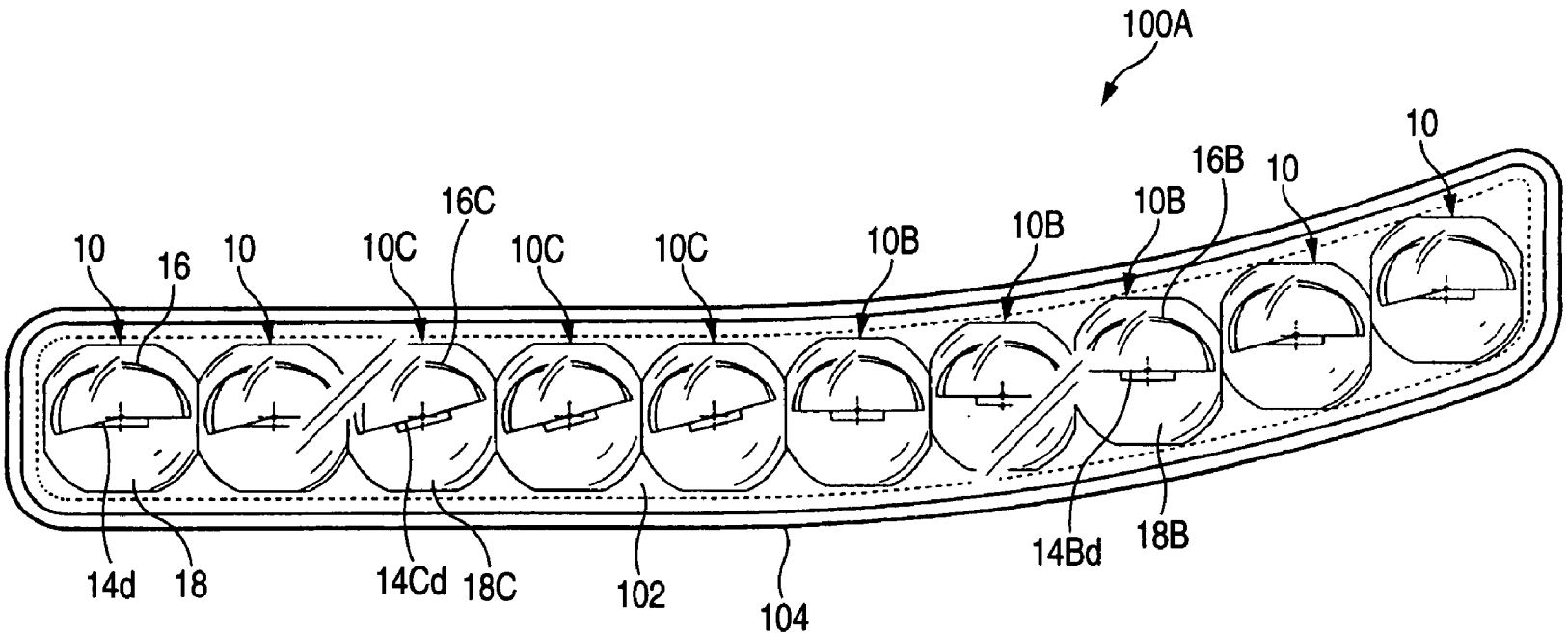
FIG. 9 is a view similar to FIG. 1 showing a second example of a vehicular lamp employing plural light source units of the invention.

FIG. 9 is a front view showing a vehicular lamp 100A according to this example.

As in the case of the first example shown in FIG. 1, the vehicular lamp 100A is also a low-beam headlamp employing ten light source units arranged in a substantially horizontal line. This example differs from the first example in that the light source units are constituted by a combination of different types of light source units.

More specifically, four of the ten light source units are the same as those of the first example, while the other six light source units are used for forming a hot zone (a high luminous intensity region). Of the latter group, three are light source units 10B for horizontal cut-off line formation and the other three are light source units 10C for oblique cut-off line formation.

A light source unit 10B for forming the horizontal cut-off line has the same basic structure as the light source unit 10, but they differ from each other in the following respect. More specifically, the entire third reflecting surface 14Bd of the translucent block 16B, which acts as a horizontal cut-off line forming surface, extends horizontally in both leftward and rightward directions from the optical axis Ax of the light source unit 10B. In the light source unit 10B, moreover, a lens having a greater rear focal length than that of the projection lens 18 of the light source unit 10 is used for the projection lens 18B.

On the other hand, the light source unit 10C for forming the oblique cut-off line also has the same basic structure as that of the light source unit 10, but they differ from each other in the following respect. More specifically, in the light source unit 10C, the entire third reflecting surface 14Cd of the of the translucent block 16C, which acts as the oblique cut-off line forming surface, extends obliquely and upward by 15 degrees in a leftward direction from the optical axis Ax and obliquely and downward by 15 degrees in a rightward direction. In the light source unit 10C, moreover, a lens having a much greater rear focal length than that of the projection lens 18B of the light source unit 10B is used for the projection lens 18C. Also, the LED 12 of the light source unit 10C is rotated by 15 degrees in the rightward direction about the optical axis Ax from the vertical direction (see FIG. 11).

Figure 10:
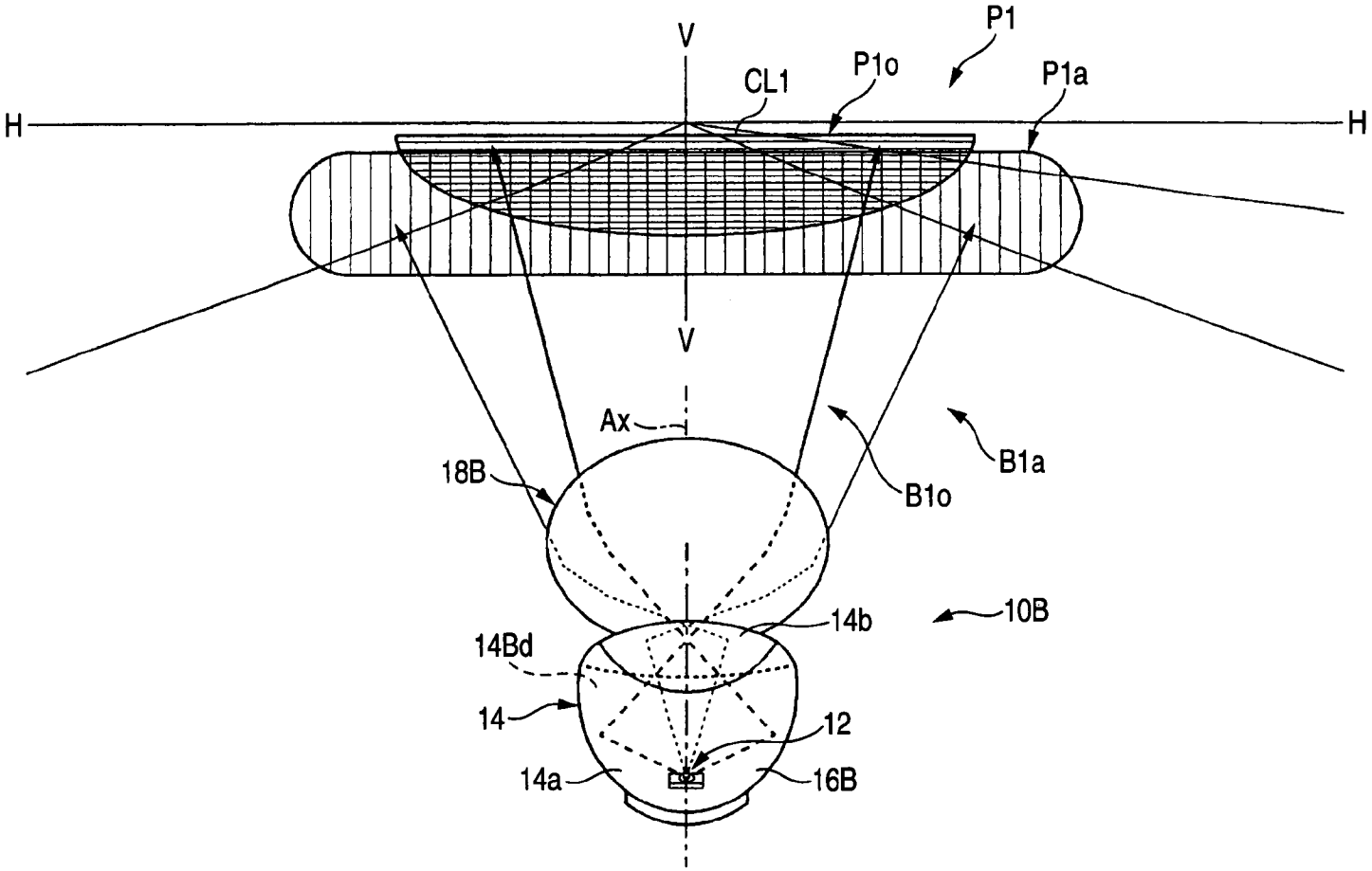
FIG. 10 is a perspective view showing a light distribution pattern formed on a virtual vertical screen by a beam having a horizontal cut-off line, together with a light source unit of the second embodiment as seen from the rear side thereof.

FIG. 10 is a perspective view showing a light distribution pattern P1 for forming the horizontal cut-off line as seen on a virtual vertical screen positioned 25 m forward of the lighting unit. The light distribution pattern P1 is formed by a beam radiated forward from the light source unit 10B. The light distribution pattern P1 is shown together with the light source unit 10B as viewed from the rear side thereof.

As shown in FIG. 10, the light distribution pattern P1 for forming the horizontal cut-off line is formed as a synthesized light distribution pattern including a basic light distribution pattern P1*o* and an additional light distribution pattern P1*a*.

The basic light distribution pattern P1*o* is formed by light reflected from the first reflecting surface 14Ba, namely, radiated light B1*o* for forming the hot zone, and it has a horizontal cut-off line CL1 on the upper edge thereof. The horizontal cut-off line CL1 is formed at the same level as the horizontal cut-off line CL1 formed from the light source unit 10.

The projection lens 18B of the light source unit 10B has a greater rear focal length than that of the projection lens 18 of the light source unit 10. As compared with the basic light distribution pattern Po formed by the light source unit 10, therefore, the basic light distribution pattern P1*o* is smaller and brighter. Consequently, the basic light distribution pattern P1*o* includes a hot zone formed along the horizontal cut-off line CL1 which enhances the visibility of distant regions on the road surface in front of the vehicle.

On the other hand, the additional light distribution pattern P1*a* is formed by light reflected from the second reflecting surface 14*b* (additional radiated light B1*a*), and is formed to overlap with the lower half part of the basic light distribution pattern P1*o* while being diffused widely in the transverse direction. The additional light distribution pattern P1*a* is also a smaller light distribution pattern than the additional light distribution pattern Pa formed by the light source unit 10 due to the greater rear focal length of the projection lens 18B. Visibility in the region on the side of the basic light distribution pattern P1*o* on the road surface forward of the vehicle is enhanced due to the provision of the additional light distribution pattern P1*a*.

Figure 11:
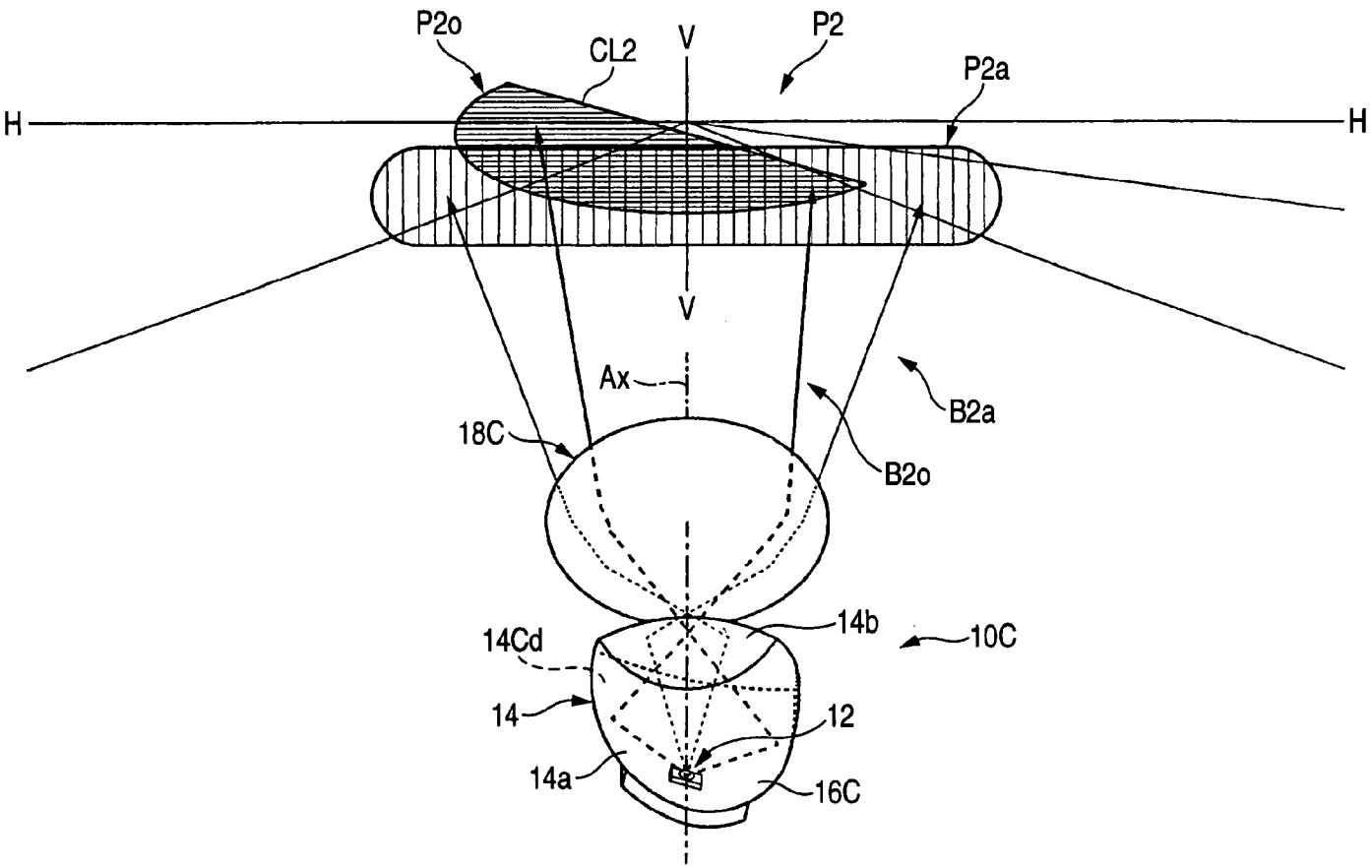
FIG. 11 is a perspective view showing a light distribution pattern formed on the virtual vertical screen by a beam having an oblique cut-off line, together with a light source unit of the second embodiment as seen from the rear side thereof.

FIG. 11 is a perspective view showing a light distribution pattern P2 for forming the oblique cut-off line as seen on a virtual vertical screen positioned 25 m forward of the lighting unit. The light distribution pattern P2 is formed by a beam radiated forward from the light source unit 10C. The light distribution pattern P2 is shown together with the light source unit 10C as seen from the rear side thereof.

As shown in FIG. 11, the light distribution pattern P2 for forming the oblique cut-off line is formed as a synthesized light distribution pattern including a basic light distribution pattern P2*o* and an additional light distribution pattern P2*a*.

The basic light distribution pattern P2*o* is formed by light reflected from the first reflecting surface 14*a* (B2*o* for forming the hot zone), and it has an oblique cut-off line CL2 on the upper edge thereof. The oblique cut-off line CL2 is formed at the same level as the oblique cut-off line CL2 formed by the light source unit 10.

The projection lens 18C of the light source unit 10C has a much greater rear focal length than that of the projection lens 18B of the light source unit 10B. As compared with the basic light distribution pattern P1*o* formed by the light source unit 10B, therefore, the basic light distribution pattern P2*o* is much smaller and brighter. Consequently, the basic light distribution pattern P2*o* includes a hot zone along the oblique cut-off line CL2 so as to enhance the visibility of distant regions on the road surface ahead of the vehicle.

On the other hand, the additional light distribution pattern P2*a* is formed by light reflected from the second reflecting surface 14*b* (additional radiated light B2*a*) and is formed to overlap with the lower half part of the basic light distribution pattern P2*o* and to be diffused widely in the transverse direction. The additional light distribution pattern P2*a* is also a much smaller light distribution pattern than the additional light distribution pattern P1*a* formed by the light source unit 10B due to the greater rear focal length of the projection lens 18C. Due to the additional light distribution pattern P2*a*, the visibility in portions of the basic light distribution pattern P2*o* along the side of the road surface ahead of the vehicle is enhanced.

Figure 12:
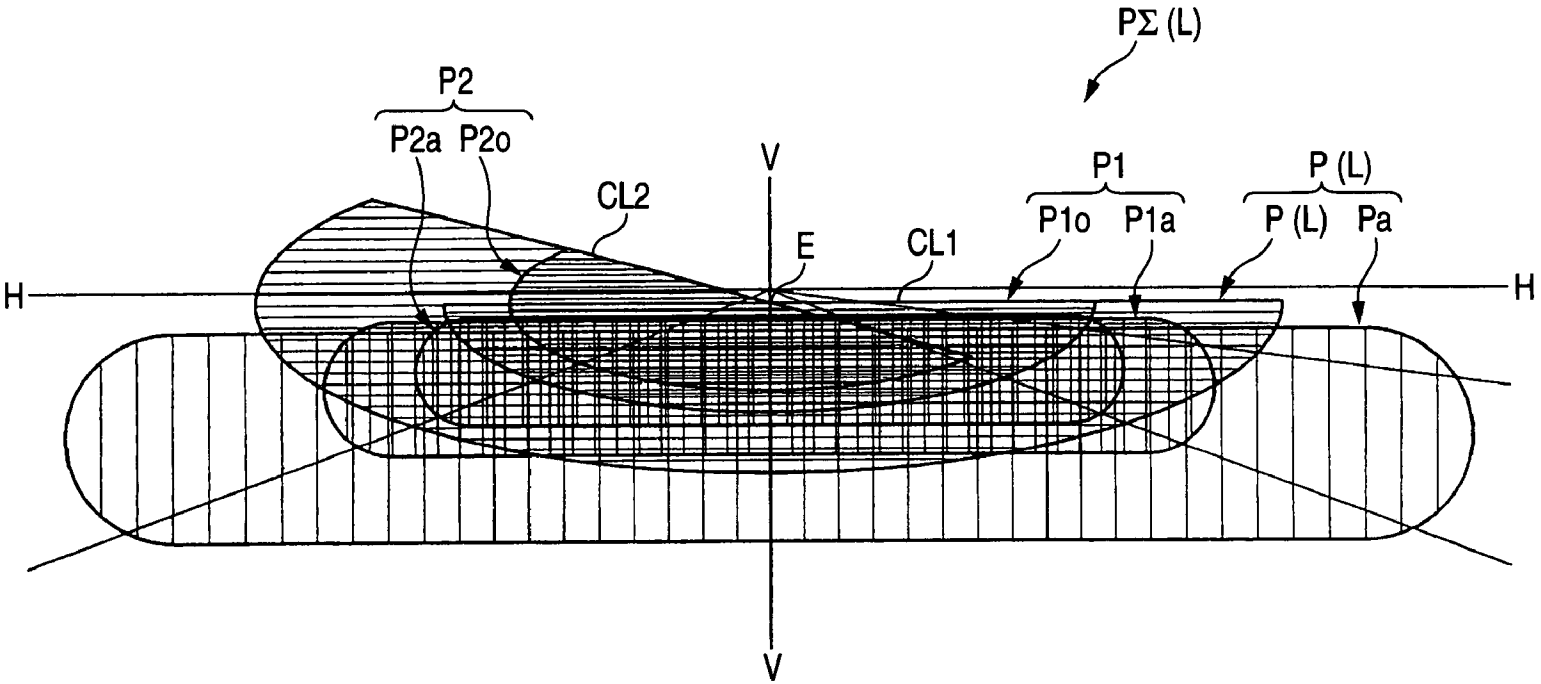
FIG. 12 is a perspective view showing a low-beam distribution pattern formed on the virtual vertical screen by a beam of a vehicular lamp employing light sources constructed according to the second embodiment.

FIG. 12 is a perspective view showing a synthesized low-beam distribution pattern PΣ(L) formed on a virtual vertical screen 25 m in front of a lighting unit by beams radiated from the vehicular lamp 100A according to this second example.

As shown in FIG. 12, the synthesized low-beam distribution pattern PΣ(L) is a composite of four low-beam distribution patterns P(L) formed by beams from four respective light source units 10. Further, the light distribution pattern P1 for forming the horizontal cut-off line is a composite of three beams radiated from three light source units 10B, and the light distribution pattern P2 for forming the oblique cut-off line is a composite of three beams from three light source units 10C.

With the vehicular lamp 100A according to this example, it is possible to obtain a synthesized low-beam distribution pattern PΣ(L) having a hot zone formed in the vicinity of an elbow point E. Consequently, it is possible to obtain low-beam radiation in a light distribution pattern providing distant visibility which is significantly enhanced.

While a vehicular lamp 100A which is constituted by a combination of three types of light source units 10, 10B and 10C has been described, it is also possible to constitute a vehicular lamp by a combination of even more types of light source units. Thus, it is possible to effect light distribution control with a high degree of precision.

Next, a third embodiment of a light source unit of the invention will be described.

Figure 13:
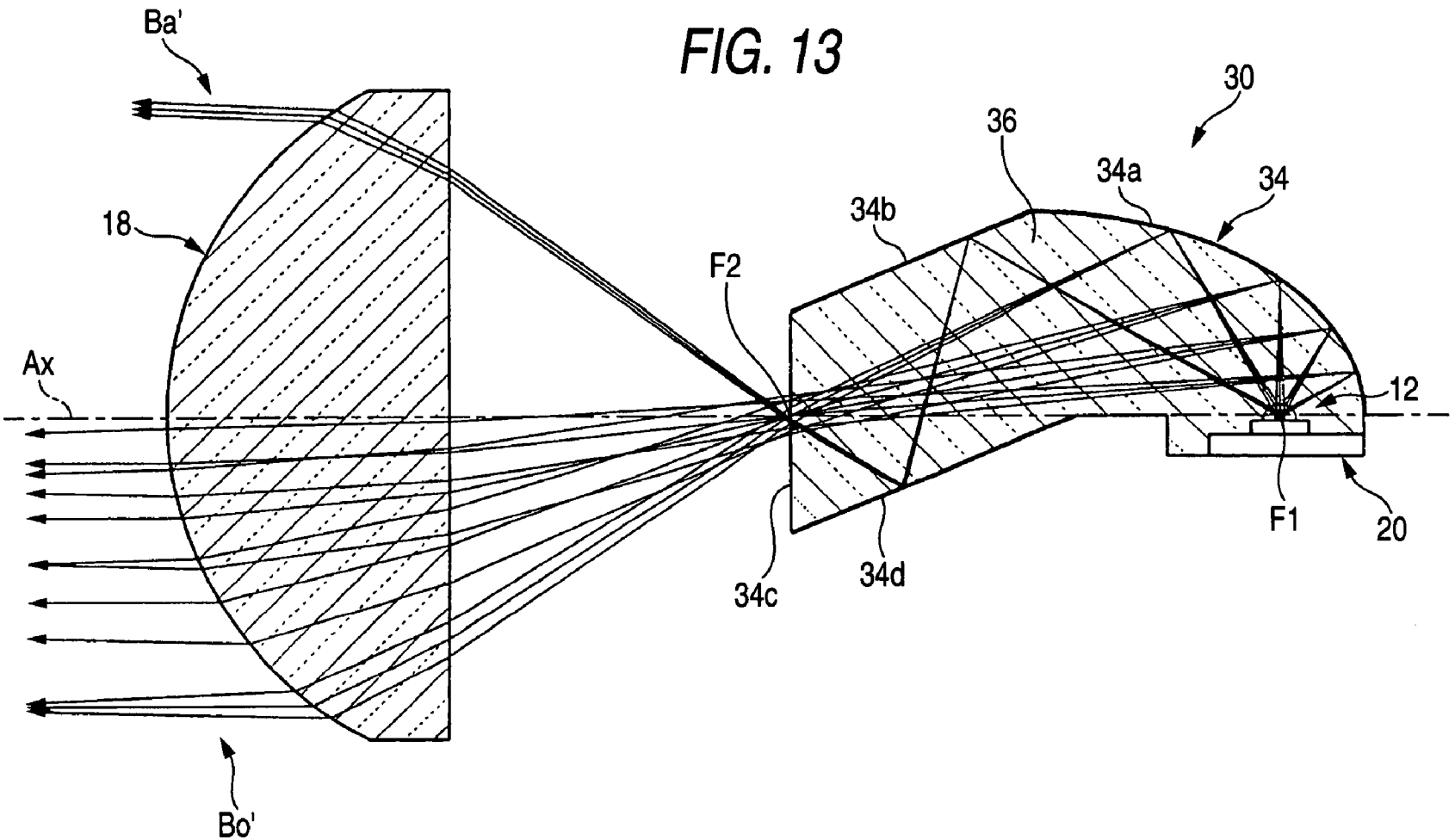
FIG. 13 is a view similar to FIG. 5 showing a third embodiment of a light source unit of the invention.

FIG. 13 is a sectional side view showing a light source unit 30 according to the third embodiment.

The light source unit 30 is designed for providing a high-beam light distribution pattern.

More specifically, as in the previously disclosed embodiments, the light source unit 30 according to the third embodiment has a reflector 34 constituted by a reflective coating formed over the surface of a translucent block 36 which covers an LED 12. In the third embodiment, however, the emitting end face 34*c* of the translucent block 36 is not fan-shaped as in the previously described embodiments, and the lower edge of the emitting end face 34*c* is at a significantly lower position than the lower edge of the emitting end face 14*c* according to the first two embodiments.

Moreover, a fourth reflecting surface 34*d* inclined forward and downward is formed on the lower end of the translucent block 36 in place of the third reflecting surface 14*d*.

The structure of a first reflecting surface 34*a* is the same as that of the first reflecting surface 14*a* of the first embodiment, but the downward inclination angle of a second reflecting surface 34*b* formed at the upper part of the front end of the first reflecting surface 34*a* is greater than the angle of inclination of the second reflecting surface 14*b* of the first embodiment.

In the third embodiment, the lower edge of the emitting end face 34*c* of the translucent block 36 is at a significantly lower position than the lower edge of the emitting end face 14*c* according to the previously described embodiments. Therefore, all of the light emitted by the LED 12 which is reflected by the first reflecting surface 34*a* reaches the emitting end face 34*c*, and the light deflected and emitted from the emitting end face 34*c* is emitted as a high beam Bo', including forward upward and downward portions, through the projection lens 18.

In the third embodiment, moreover, the light emitted by the LED 12 which is reflected by the second reflecting surface 34*b* is reflected by the fourth reflecting surface 34*d* again and reaches the emitting end face 34*c*, and the light deflected and emitted from the emitting end face 34*c* is emitted as additional radiated light Ba' including forward, upward and downward portions, through the projection lens 18. The direction of radiation of the additional irradiated light Ba' varies depending on the reflecting position on the fourth reflecting surface 34*d*, and more upwardly directed light than the high beam light Bo' is widely radiated in the transverse direction.

Figure 14:
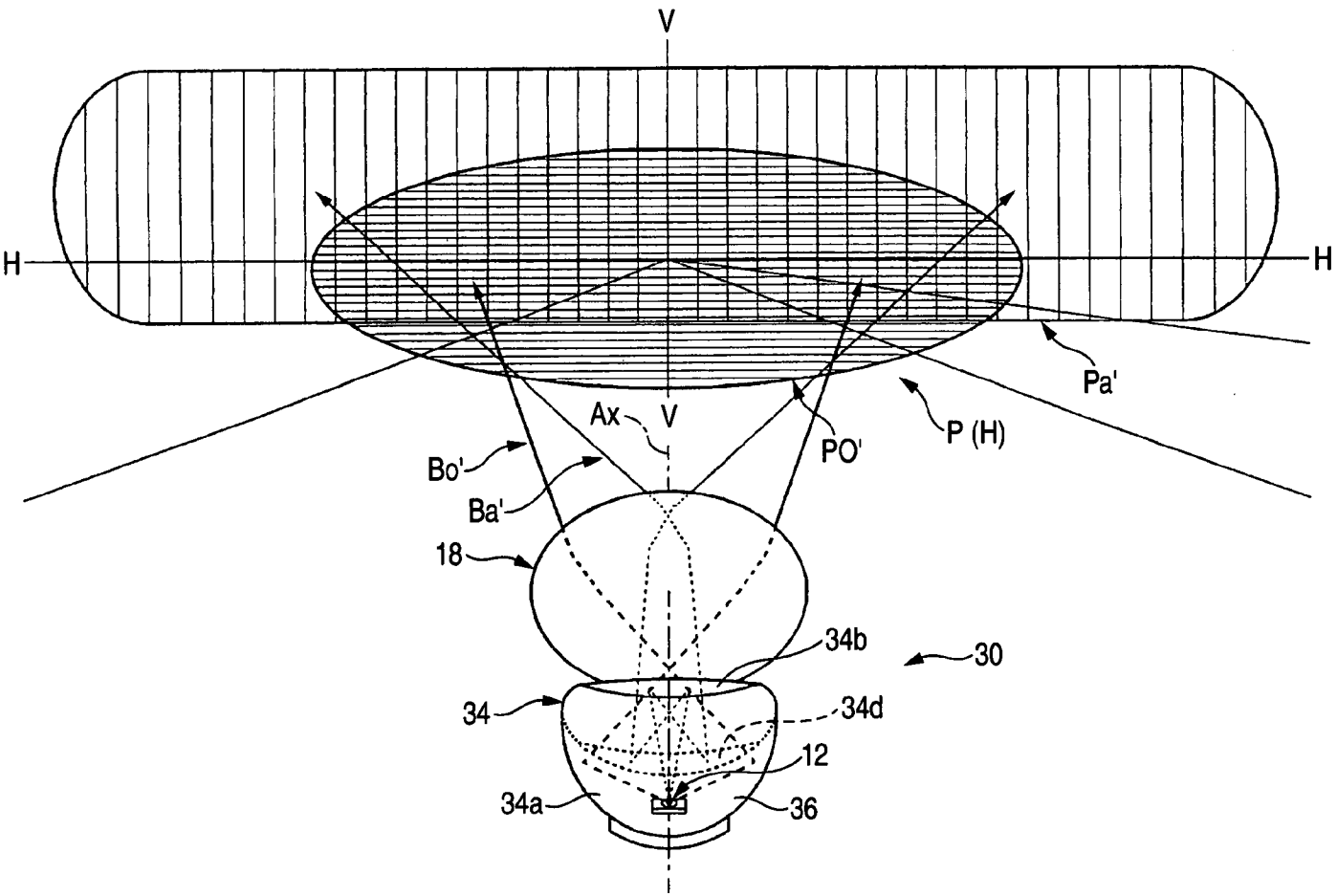
FIG. 14 is a view similar to FIG. 6 showing a light distribution pattern formed on a virtual screen by a beam of a light source unit of the third embodiment.

FIG. 14 is a perspective view showing a high-beam distribution pattern P(H) formed on a virtual vertical screen 25 m forward of the lighting unit by a beam radiated from the light source unit 30, together with the light source unit 30 as seen from the rear side thereof.

As shown in FIG. 14, the high-beam distribution pattern P(H) is formed as a synthesized light distribution pattern including a basic light distribution pattern Po' and an additional light distribution pattern Pa'.

The basic light distribution pattern Po' is formed by light reflected from the first reflecting surface 34*a* (the high-beam radiated light Bo'), and has a shape such that the basic light distribution pattern Po according to the first embodiment is extended upward. With the basic light distribution pattern Po' light is radiated forward of the vehicle in a generally wide pattern centered substantially about the H-V intersection.

The additional light distribution pattern Pa' formed by light reflected from the fourth reflecting surface 34*a* (the additional radiated light Ba') overlaps the upper half of the basic light distribution pattern Po' and is diffused widely in the transverse direction. The additional light distribution pattern Pa' provides light radiated more widely forward of vehicle.

By using a proper combination of the light source unit 30 according to the third embodiment and the light source unit 10 according to the first embodiment, it is also possible to produce a headlamp capable of producing both a low beam and a high beam.

In the above-described embodiments, the translucent blocks 16, 16B, 16C and 36 constituting the reflectors 14 and 34 are provided separately from the LED 12. In general, the LED is provided with a sealing resin section covering a light-emitting section thereof. By increasing the size of the sealing resin section, therefore, it is also possible to constitute the translucent blocks 16, 16B, 16C and 36.

While examples have been described in which the light source units 10, 10A, 10B, 10C and 30 are used in a headlamp, the light source units 10, 10A, 10B, 10C and 30 can also be used for a fog lamp or a cornering lamp while obtaining the same functions and effects as those in the above-described examples.

It should further be apparent to those skilled in the art that various changes in form and detail of the invention as shown and described above may be made. It is intended that such changes be included within the spirit and scope of the claims appended hereto.

What is claimed is:

1. A light source unit for a vehicular lamp, comprising: a semiconductor light-emitting element disposed on an optical axis of said light source unit with its light output directed in a predetermined direction substantially orthogonal to said optical axis, and a translucent or transparent block covering said semiconductor light-emitting element and having a reflective coating formed on at least a portion of an outer surface thereof to form a reflector comprising a first reflecting surface on a forward side of said translucent or transparent block in said predetermined direction with respect to said semiconductor light-emitting element, said first reflecting surface collecting light emitted by said semiconductor light-emitting element and reflecting said light forward in a direction of said optical axis.

2. The light source unit according to claim 1, wherein a distance in said predetermined direction from the semiconductor light-emitting element to said first reflecting surface is 20 mm or less.

3. The light source unit according to claim 1, wherein a distance in said predetermined direction from the semiconductor light-emitting element to said first reflecting surface is approximately 10 mm.

4. The light source unit according to claim 1, wherein said reflector comprises a second reflecting surface at a front end thereof in the direction of the optical axis of said first reflecting surface, said second reflecting surface being inclined forward in said direction of said optical axis.

5. The light source unit according to claim 1, wherein an emitting end face for emitting light reflected by said reflector is substantially fan shaped about said optical axis.

6. The light source unit according to claim 5, wherein a lower edge of said emitting end face comprises a horizontal cut-off line forming section having a first portion extending horizontally in a leftward direction from said optical axis and a second portion forms an oblique cut-off line forming section extending obliquely and downward from said optical axis.

7. The light source unit according to claim 4, wherein said reflector comprises a third reflecting surface, said third reflecting surface being formed on a substantially planar surface of said translucent or transparent block opposite said second reflecting surface and extending rearward from an emitting end face of said translucent or transparent block for reflecting light reflected by said first reflecting surface toward said emitting end face.

8. The light source unit according to claim 1, further comprising a projection lens provided at a predetermined position on a forward side in said direction of said optical axis with respect to said reflector.

9. The light source unit according to claim 1, wherein said reflector is substantially dome shaped in a region of said first reflecting surface, and wherein said first reflecting surface is substantially elliptical in a cross section in said predetermined direction and including said optical axis.

10. A light source unit for a vehicular lamp, comprising: a semiconductor light-emitting element disposed on an optical axis of said light source unit with its light output directed in a predetermined direction substantially orthogonal to said optical axis, and a substantially dome-shaped translucent or transparent block covering said semiconductor light-emitting element and having a reflective coating formed on at least portion of an outer surface thereof to form a reflector comprising a first reflecting surface on a forward side of said translucent or transparent block in said predetermined direction with respect to said semiconductor light-emitting element, said first reflecting surface being substantially elliptical in a cross section in said predetermined direction and including said optical axis, said first reflecting surface collecting light emitted by said semiconductor light-emitting element and reflecting said light forward in a direction of said optical axis, a second reflecting surface at a front end of said first reflecting surface in the direction of said optical axis, said second reflecting surface being inclined forward in said direction of said optical axis, and a third reflecting surface formed on a substantially planar surface of said translucent or transparent block opposite said second reflecting surface and extending rearward from an emitting end face of said translucent or transparent block for reflecting light reflected by said first reflecting surface toward said emitting end face, said emitting end face being substantially fan shaped about said optical axis, a lower edge of said emitting end face comprising a horizontal cut-off line forming section having a first portion extending horizontally in a leftward direction from said optical axis and a second portion forming an oblique cut-off line forming section extending obliquely and downward from said optical axis.

11. The light source unit according to claim 10, wherein a distance in said predetermined direction from the semiconductor light-emitting element to said first reflecting surface is 20 mm or less.

12. The light source unit according to claim 10, wherein a distance in said predetermined direction from the semiconductor light-emitting element to said first reflecting surface is approximately 10 mm.

13. The light source unit according to claim 10, further comprising a projection lens provided at a predetermined position on a forward side in said direction of said optical axis with respect to said reflector.

14. The light source unit according to claim 10, wherein said semiconductor light-emitting element is positioned at a first focal point of said first reflecting surface.

* * * * *